US006588400B2

(12) United States Patent
Gyoergy et al.

(10) Patent No.: US 6,588,400 B2
(45) Date of Patent: Jul. 8, 2003

(54) MULTI-STRIKE THROTTLE MINIMUM LEARNING SYSTEM

(75) Inventors: Thomas E. Gyoergy, Clarkston, MI (US); Joyce Dale Carsey, Swartz Creek, MI (US)

(73) Assignee: Delphi Technologies, Inc., Troy, MI (US)

( * ) Notice: Subject to any disclaimer, the term of this patent is extended or adjusted under 35 U.S.C. 154(b) by 21 days.

(21) Appl. No.: 09/855,198

(22) Filed: May 14, 2001

(65) Prior Publication Data

US 2002/0166538 A1 Nov. 14, 2002

(51) Int. Cl.[7] ..... F02D 1/00
(52) U.S. Cl. ..... 123/399; 123/361; 73/118.1
(58) Field of Search ..... 123/399, 361, 123/339.1; 73/118.1

(56) References Cited

U.S. PATENT DOCUMENTS

| | | | | | |
|---|---|---|---|---|---|
| 4,785,785 | A | | 11/1988 | Oba et al. | 123/488 |
| 5,033,431 | A | | 7/1991 | Poirier et al. | 123/339 |
| 5,333,109 | A | | 7/1994 | Oo et al. | 364/426.04 |
| 5,568,386 | A | * | 10/1996 | Sugiura et al. | 123/361 |
| 5,578,749 | A | | 11/1996 | Mogaki | 73/118.1 |
| 5,586,534 | A | | 12/1996 | Fujimoto | 123/325 |
| 5,823,164 | A | * | 10/1998 | Seki et al. | 123/361 |
| 5,964,202 | A | * | 10/1999 | Takagi et al. | 123/339.1 |
| 5,983,860 | A | | 11/1999 | Kitamura et al. | 123/399 |
| 6,009,853 | A | | 1/2000 | Fujikawa et al. | 123/396 |
| 6,032,519 | A | | 3/2000 | Ishii et al. | 73/117.3 |
| 6,067,960 | A | | 5/2000 | Watanabe | 123/399 |
| 6,073,610 | A | | 6/2000 | Matsumoto | 123/396 |
| 6,263,858 | B1 | * | 7/2001 | Pursifull et al. | 123/361 |
| 6,295,967 | B1 | * | 10/2001 | Weber et al. | 123/361 |
| 6,345,604 | B1 | * | 2/2002 | Ahrns et al. | 123/361 |

* cited by examiner

*Primary Examiner*—John Kwon
(74) *Attorney, Agent, or Firm*—Vincent A. Cichosz

(57) ABSTRACT

A multi-strike throttle minimum learning system compares a signal received from at least one throttle position sensor to a predetermined minimum throttle position range based on throttle system component tolerances. A possible throttle obstruction is indicated when all of the sensor signal minimum values are outside the predetermined minimum range. In this case, the system deactivates electrical power for a predetermined delay period and then initiates another learn attempt in an effort to overcome the obstruction. This cycle is repeated until a valid throttle minimum position is detected, the number of learn attempts reaches a preset maximum, or a sensor fault is detected. If a valid throttle position minimum is detected within the allowed number of learning attempts, normal engine startup proceeds; otherwise, appropriate fault codes are communicated to the balance of the engine management system and, ultimately, to the operator.

13 Claims, 3 Drawing Sheets

MULTI-STRIKE THROTTLE MINIMUM LEARNING SYSTEM

TECHNICAL FIELD

The present invention relates to a software algorithm for learning the minimum throttle position on an engine having an electronically controlled throttle actuator, and more particularly, to an algorithm capable of making multiple learning attempts in an effort to overcome a throttle obstruction.

BACKGROUND OF THE INVENTION

For the purpose of this description and in the sections that follow, the term throttle is used to describe the mechanism that regulates the delivery of fuel, air, or air-fuel mixture to the engine in a motor vehicle. There may or may not be a mechanical linkage between the accelerator pedal and the throttle.

On throttle control systems without non-volatile memory and pop-up default air throttle positions, it is necessary for the subsystem to learn the minimum throttle position so that the throttle can be controlled with respect to that minimum position.

It has been found that during cold weather, ice can form in the bore of the throttle body resulting in a throttle obstruction that may prevent complete closing of the throttle and thus prevent learning of the actual throttle position minimum at power on. This can result in a "Service Engine Soon" indication and less than optimal powertrain performance. In some cases, the system may go into a failsafe mode executing a limp home algorithm. Thus, accurate determination of the throttle position minimum is critical to the operation of the throttle control system and vehicle performance.

Such weather related obstruction problems can often be overcome by the use of higher capacity actuators or the addition of non-volatile memory, both of which increase system cost, or the use of more aggressive gear reduction, which negatively impacts system time response characteristics.

Various throttle control systems have been developed that include the use of sensors to detect and control throttle position including the learning of a fully closed throttle state.

The algorithm 200 shown in FIG. 2 is a known algorithm typical of the single strike ECU strategies that attempt to establish a minimum throttle position. The algorithm starts with step S202 to initialize a program timer. This is followed by step S204 wherein constants programmed at the time the algorithm is loaded onto the ECU to represent sensor minimum values are read for reference. In the next step, S206, a throttle sensor signal is received by the ECU. In the final step, S208, the throttle sensor reading is examined to determine whether it indicates a valid minimum throttle position. If the result is valid, normal engine startup proceeds; otherwise, a fault condition is raised and a failure indicator is communicated to the balance of the engine management system and, ultimately, to the operator. The prior art in this field is limited to such single strike learning techniques.

Consequently, there remains a need for a throttle control system that can accurately determine the minimum throttle position, including the ability to overcome minor throttle obstructions, prior to engine run state so that optimum engine performance can be achieved.

SUMMARY OF THE INVENTION

The present invention provides a system capable of making multiple attempts at learning a minimum throttle position in an effort to overcome a throttle obstruction. The determination of an accurate throttle minimum position is necessary to assure optimum vehicle performance.

In a preferred embodiment of the invention, a multi-strike throttle minimum learning system includes a pair of throttle position sensors, each producing a signal indicative of the position of an electronically actuated throttle valve. The throttle position signals are communicated to an ECU containing reusable memory and operable to execute an algorithm for controlling the minimum learning process during engine startup.

According to one preferred method of learning the throttle position minimum, a software algorithm first initializes a learn-attempt counter and stores a predetermined throttle minimum position value range based on throttle system component tolerances. Signals from the throttle position sensors are received and compared to the pre-established throttle minimum value range. If the sensors indicate that a valid throttle minimum position is established, the ECU saves the minimum position value and execution of the algorithm is terminated. If a valid minimum throttle position is not sensed, a throttle obstruction is assumed and subsequent learn attempts are made until either a valid throttle position minimum is sensed, indicating that the obstruction was overcome, or a predetermined maximum number of learn attempts is reached, with the appropriate result being communicated by the ECU to certain preselected subsystems of the vehicle. Between learn attempts, power to the system is deactivated for a predetermined delay period and then reapplied so that the throttle actuator can attempt to place the throttle valve in a full closed position. In another feature of the preferred embodiment, the execution of the algorithm is terminated if a sensor fault is detected.

Accordingly, it is one object of the invention to provide improved algorithm for learning the minimum throttle position on an engine having an electronically controlled throttle actuator. These and other objects, advantages and features are accomplished according to the devices and assemblies of the present invention.

DESCRIPTION OF THE PREFERRED EMBODIMENT

Figure 1:
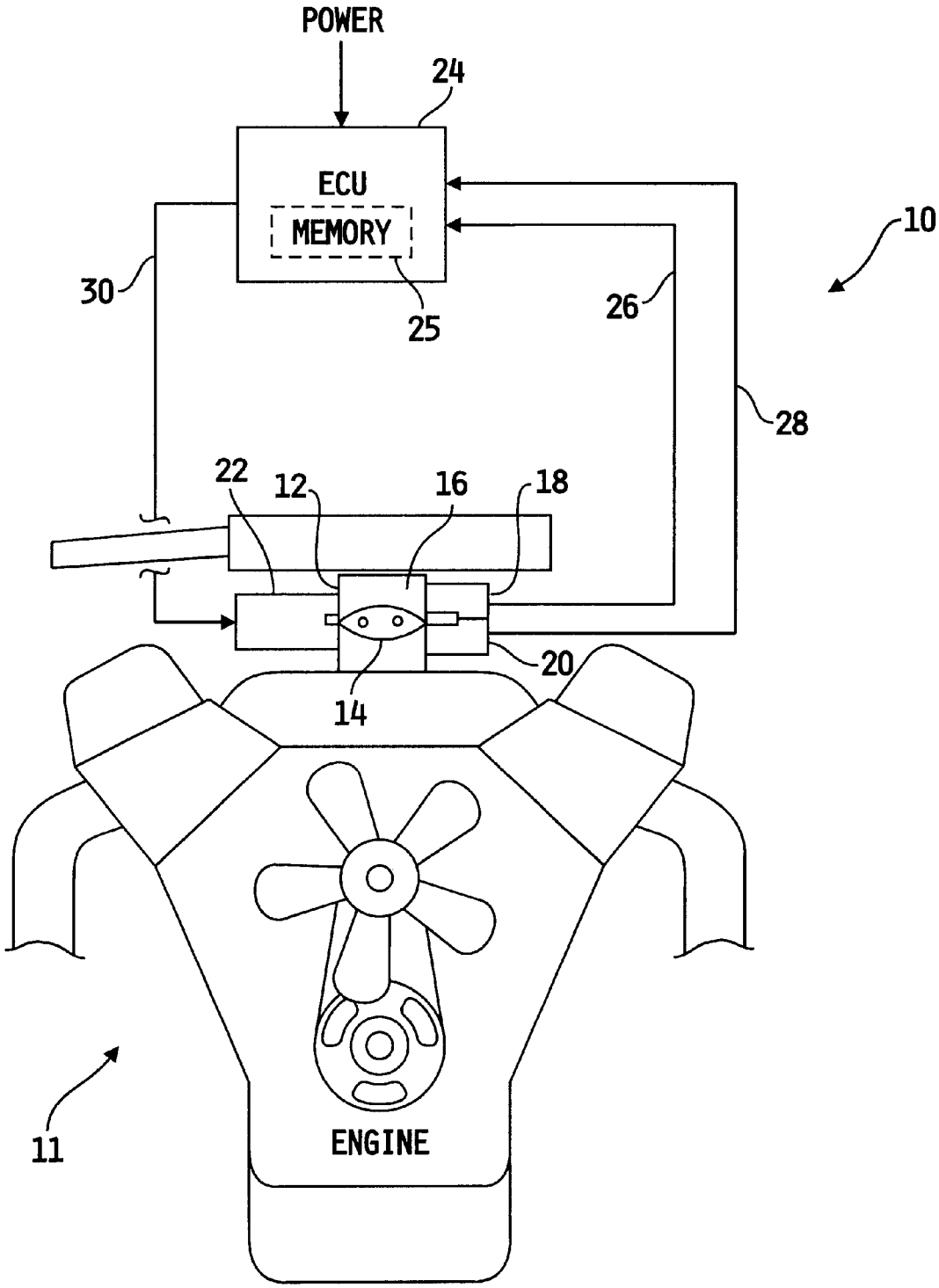
FIG. 1 is a schematic and block diagram of an internal combustion engine with an electronic control system including an electronically controlled throttle actuator.
Figure 2:
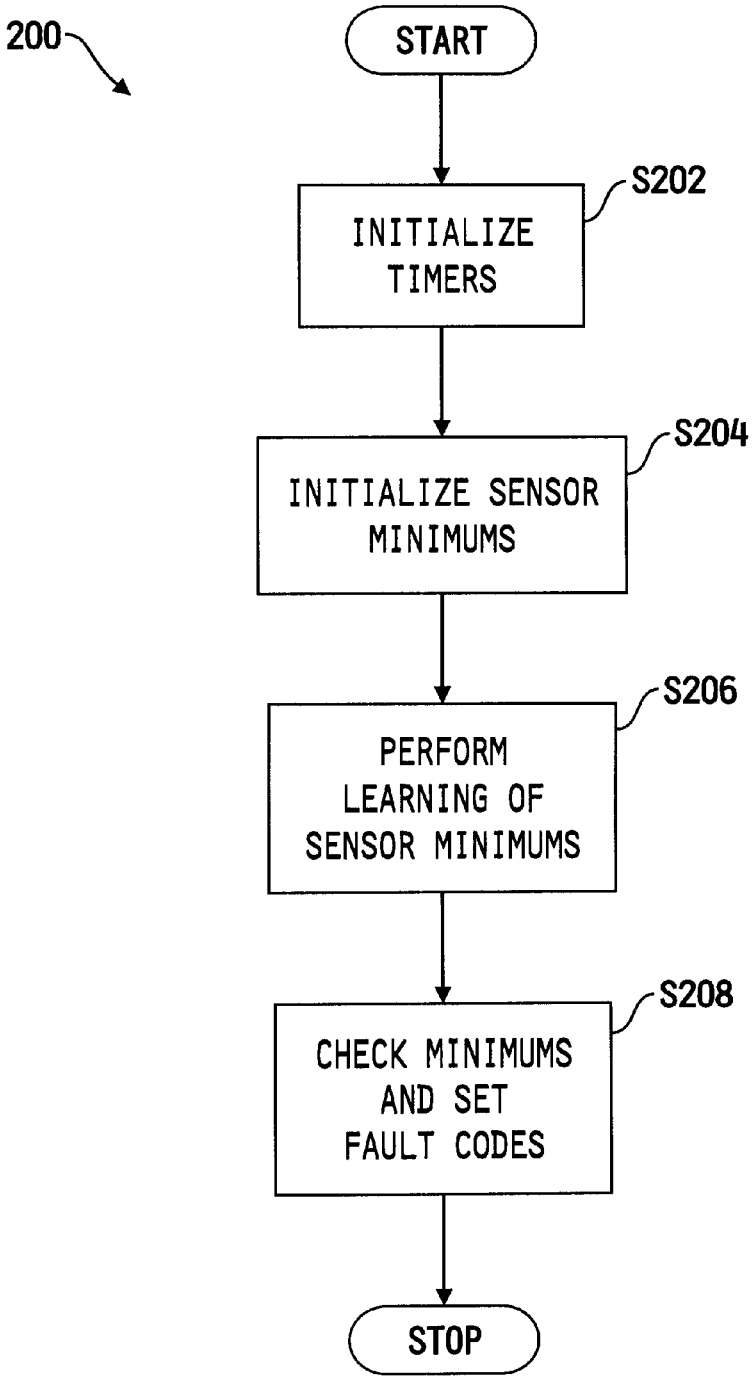
FIG. 2 (PRIOR ART)
FIG. 2 is a flowchart of a conventional throttle position minimum learn algorithm illustrative of the prior art.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

A throttle control system 10 for use with an internal combustion engine 11 is depicted in FIG. 1. Central to the control system 10 is a control computer or ECU 24. The engine 11 is provided with a throttle valve 14 of known construction positioned in an air intake passage 16 of a throttle body 12. At least one known throttle sensor for detecting the position of throttle valve 14 relative to the throttle body 12 is suitably attached to the throttle body 12. In a preferred embodiment, two such sensors, 18 and 20 are used as shown in FIG. 1. Each throttle position sensor 18 and 20 provides a signal 26 and 28 indicative of throttle position to the ECU 24. Preferably the throttle body 12 has a minimum throttle position as is known in the art which corresponds to the fully closed position of the throttle valve 14. A throttle actuator 22, attached to the throttle body 12, controls the position of throttle valve 14 relative to throttle body 12 based an actuation control provided by the ECU 24 in response to operator commands. The actuator component is of known construction to those skilled in the art. In FIG. 1, the ECU 24 is shown as a separate stand-alone unit. Alternatively the ECU 24 can be a part of a more comprehensive engine control unit. Or, in another embodiment, the ECU can be limited to control just the throttle actuator, in which case it could be integral with the throttle actuator 22.

Figure 3:
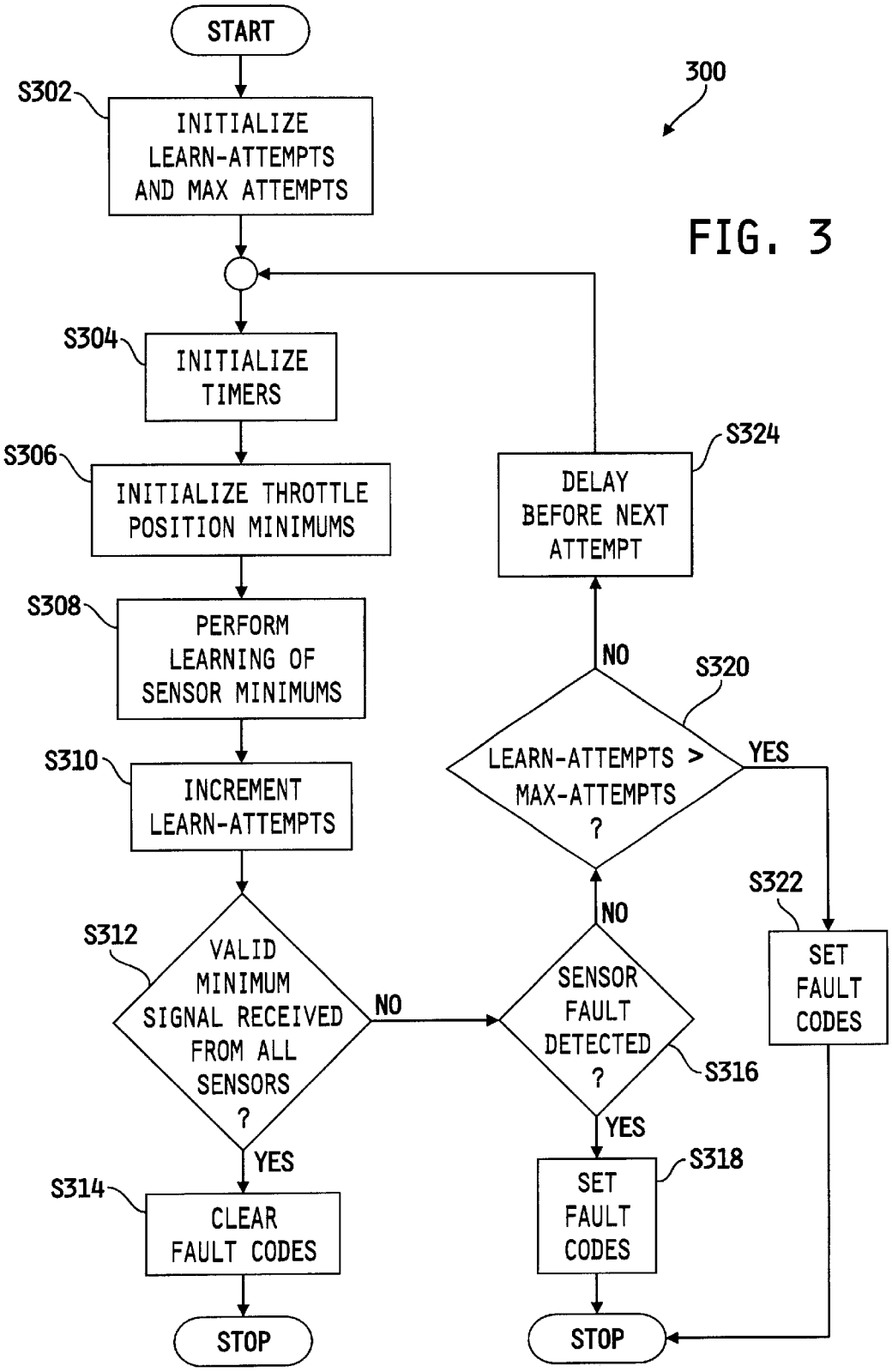
FIG. 3 is a flowchart illustrating one preferred embodiment of a throttle position minimum learning algorithm, in accordance with the present invention.

The ECU 24 contains reusable memory 25 in one of various forms well known in the art and is operable to execute the algorithm represented by the flow chart of FIG. 3. Upon the application of power, the ECU 24 signals the actuator 22 to place the throttle valve 14 in throttle body minimum position representing a closed throttle position. Then the minimum learning algorithm 300 of FIG. 3 is executed by ECU 24 before cranking of the engine is initiated. As instructed by the algorithm 300, the ECU 24 first initializes a learn-attempt counter in step S302. This is loaded into memory along with a max-attempts constant. The learn-attempt counter is typically initialized at zero. The max-attempts value is a preset constant loaded onto the ECU 24 when the algorithm is loaded and represents the maximum number of times the algorithm will be executed to try to learn a minimum throttle position. Next, the ECU 24 initializes a system timer as directed by step S304.

ECU 24 is operable at step S306 to load throttle position minimum range data into memory. This minimum range is determined based on mechanical tolerances of the throttle system components and represents a range of throttle positions relative to the throttle body that is acceptable as a fully closed position or minimum throttle position. The sensor signal values representative of this throttle position minimum range are loaded onto the ECU 24 as program constants when the minimum learning algorithm 300 is loaded onto the ECU 24.

At step S308, the ECU 24 is operable to receive a signal from each throttle position sensor. The sensor signals are converted to a relative throttle position value and saved as a proposed minimum value. In a referred embodiment, two throttle position sensors are used. Since both sensors are measuring the same entity, both are expected to return signals that are approximately the same. The sensor signals are compared in a later step to verify that they are working properly. Next, in step S310, the ECU 24 increments the learn-attempt counter.

From step S310, execution of the algorithm continues with step S312 where the ECU 24 compares the converted sensor signal values to the initialized sensor minimum values. If all sensors return signals corresponding to a throttle minimum within the predetermined minimum range, the system is deemed to have learned a valid throttle minimum. In this case, execution advances to step S314 where the ECU 24 clears any fault codes in memory relating to sensor learning. The ECU 24 then stops execution of the algorithm 300 and engine start up continues.

If at step S312, the ECU 24 determines that all sensor signals are not representative of a valid throttle minimum, step S316 is executed to check for sensor faults. If at least one sensor, but not all sensors, returns a signal representative of a valid throttle minimum, the ECU 24 concludes that a sensor fault exists. In this case, algorithm execution advances to step S318, where ECU 24 sets fault codes in memory corresponding to a sensor fault. The ECU 24 then stops execution of the algorithm 300 and communicates the sensor fault condition to the engine management system for ultimate presentation to the operator.

If, in step S316, the ECU 24 determines that all sensor signals represent throttle openings outside the valid minimum range, a throttle obstruction is presumed and the ECU 24 continues execution with step S320 to determine whether another attempt to learn a valid throttle minimum will be made. In step S320, the ECU 24 compares the learn-attempt counter to the preset max-attempts value in memory. If the ECU 24 determines that the max-attempts value has not been exceeded, algorithm execution advances to step S324 where the ECU 24 pauses for a predetermined delay period, during which time, power to the throttle actuator is deactivated. After the delay, power is reapplied and another learn attempt is made by returning to step S304. If the max-attempts value has been exceeded, execution proceeds to step S322 where fault codes reflecting an inability to overcome the throttle obstruction are set. The ECU 24 then stops algorithm execution and communicates the fault condition to the balance of the engine management system and, ultimately, to the operator.

In view of the foregoing, it should now be understood that the algorithm described is a multi-strike minimum learning algorithm capable of making multiple throttle minimum learning attempts when a throttle obstruction is detected. It has been found that in the case of some types of blockages, such as ice formation inside the throttle body, a subsequent learn attempt can overcome the obstruction. The algorithm is loaded onto the ECU along with a set of program constants including at least the maximum number of learn attempts to overcome the obstruction, the acceptable minimum throttle range, and the time delay period between learn attempts or executions of the algorithm. The algorithm represents an instruction set carried out by the ECU. Execution of the algorithm starts by loading the constants into memory and initializing program timers and the learn-attempt counter. The ECU receives and evaluates signals from the throttle position sensors. Preferably two sensors are employed, both measuring the throttle valve position relative to the throttle body. When both sensors return signals representing a valid throttle minimum, engine startup is allowed to proceed. Where both sensor signals represent invalid minimum throttle positions, a throttle obstruction is presumed and subsequent learn attempts are made until the ECU determines that a valid throttle minimum has been learned or the maximum number of learn attempts has been reached. Where one sensor signal represents a valid minimum throttle position and the other does not, a sensor fault in at least one sensor has occurred. Where the system has failed to learn a valid minimum throttle position, the ECU sets appropriate fault codes and communicates this information to the balance of the engine management system and, ultimately, to the operator.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A method for learning a minimum position of a throttle valve used in an electronically-controlled throttle actuator of an internal combustion engine, comprising:

commanding the throttle valve to a closed throttle position;

measuring throttle position; and, comparing the measured throttle position to a predetermined throttle position minimum range.

2. The method of claim 1 further comprising deactivating the commanding the throttle valve to a closed throttle position for a predetermined delay period when the measured throttle position is outside the predetermined throttle position minimum range.

3. The method of claim 2, further comprising reactivating the commanding the throttle valve to a closed throttle position after the predetermined delay period.

4. The method of claim 3, further comprising monitoring a quantity of learn attempts by incrementing a counter after each measuring of the throttle position.

5. The method of claim 3, wherein learning the minimum position of the throttle valve for the internal combustion engine occurs before cranking of the internal combustion engine is initiated.

6. The method of claim 4, further comprising setting a fault code when the quantity of learn attempts exceeds a predetermined value.

7. The method of claim 6, further comprising erasing the fault code when the measured throttle position is within the predetermined throttle position minimum range.

8. The method of claim 7, further comprising determining there is a valid throttle position value when the measured throttle position is within the predetermined throttle position minimum range.

9. A system for learning a minimum position of a throttle valve used in an electronically-controlled throttle actuator of an internal combustion engine, comprising a controller operable to:

command the throttle valve to a closed throttle position, measure throttle position with at least one throttle position sensor, and, compare the measured throttle position to a predetermined throttle position minimum range.

10. The system of claim 9, wherein the throttle position is measured using a first throttle position sensor and a second throttle position sensor.

11. The system of claim 9, wherein the controller is operable to learn the minimum position of the throttle valve for the internal combustion engine before initiation of crank of the internal combustion engine.

12. The system of claim 9, wherein the controller is operable to deactivate the command the throttle valve to a closed throttle position for a predetermined delay period when the measured throttle position is outside the predetermined throttle position minimum range.

13. The method of claim 12, wherein the controller is operable to reactivate the command to the throttle valve to a closed throttle position after the predetermined delay period.

* * * * *